United States Patent [19]

Hara et al.

[11] Patent Number: 5,014,658

[45] Date of Patent: May 14, 1991

[54] PISTON ASSEMBLY HAVING A FUSIBLE CORE TO FORM A COOLING CHANNEL AND A METHOD FOR THE MANUFACTURE THEREOF

[75] Inventors: Soichi Hara; Hiroshi Kageyama, both of Toyota, Japan

[73] Assignee: Aisin Seiki Kabushiki Kaisha, Kariya, Japan

[21] Appl. No.: 482,655

[22] Filed: Feb. 21, 1990

[30] Foreign Application Priority Data

Feb. 22, 1989 [JP] Japan ..... 1-42154

[51] Int. Cl.[5] ..... F02F 3/00

[52] U.S. Cl. ..... 123/193 P; 92/208

[58] Field of Search ..... 123/193 P; 29/888.04, 29/888.042, 888.047; 92/208, 186, 176; 164/30, 121, 522

[56] References Cited

U.S. PATENT DOCUMENTS 3,991,811 11/1976 Diez et al. ..... 164/121
4,361,181 11/1982 Wischnak et al. ..... 164/522
4,506,632 3/1985 Kanda et al. ..... 123/193 P
4,586,553 5/1986 Allen et al. ..... 164/30
4,776,075 10/1988 Kawabata et al. ..... 29/888.047
4,891,875 1/1990 Sochi et al. ..... 123/193 P

FOREIGN PATENT DOCUMENTS 2055448 3/1981 United Kingdom ..... 92/186

*Primary Examiner*—Andrew M. Dolinar
*Assistant Examiner*—M. Macy
*Attorney, Agent, or Firm*—Oblon, Spivak, McClelland, Maier & Neustadt

[57] ABSTRACT

A piston is formed with a cooling channel in its crown by dissolving a fusible core cast into the crown. The fusible core is supported prior to casting by a strut which is itself supported on a plurality of cores which help to find the piston cavity. The plurality of cores are configured so as to be removable from the strut, after casting, in a downward direction. The fusible core is dissolved by introducing a dissolving liquid to the fusible core via inlet or outlet passages cut between the cavity and the fusible core.

7 Claims, 3 Drawing Sheets

PISTON ASSEMBLY HAVING A FUSIBLE CORE TO FORM A COOLING CHANNEL AND A METHOD FOR THE MANUFACTURE THEREOF

BACKGROUND OF THE INVENTION

1. Field of the Invention

The present invention relates to a piston and more particularly to a piston assembly for an internal combustion engine having a fusible core to form a cooling channel and a method for the manufacture thereof.

2. Background of the Related Art

A conventional method for manufacturing a piston is disclosed in Japanese Unexamined Publication No. 51(1976)-99719, and is shown in FIG. 5. First, a piston 70 is formed by casting (e.g., by gravity die casting or squeeze casting, etc.). The piston 70 is a unitary casting defining a piston crown portion 71, combustion chamber portion 72, a piston skirt portion 73 surrounding a cavity 74, and a pair of bosses 75. Grooves 76 are then cut in a peripheral surface of the piston crown portion 71 and a pair of holes 77 are formed in the bosses 75.

Next, a ring shaped groove 78 is cut in the piston crown portion 71. An inlet 79 and an outlet 80 are cut in the piston for connecting between the cavity 74 and the ring shaped groove 78. A ring member 81 is put into an upper portion of the ring shaped groove 78, and the ring member 81 is welded to the piston 70 by friction welding.

Therefore, the piston 70 has a cooling channel system 84. When the piston 70 is driven in an engine (not shown), oil pumped out from a pump 83 through a nozzle 82 enters the ring shaped groove 78 through the inlet 79. The oil in the ring shaped groove 78 cools the piston crown portion 71 and is discharged back to the cavity 74 through the outlet 80. Consequently, the piston 70 is cooled so that its life is long.

In the above-described method for manufacturing the piston, the cooling chanel system 84 is formed in the piston by use of welding processes and cutting processes, which are time consuming.

SUMMARY OF THE INVENTION

It is a primary object to the present invention to provide a piston assembly having a cooling channel, without the need for welding a ring onto the piston crown.

It is another object to the present invention to provide a method for manufacturing a piston having a cooling channel, without having the need for welding a ring onto the piston crown.

According to a feature of the invention, a cast piston has a crown and a peripherally depending skirt which together define a cavity on the lower side of the crown. A cooling channel is formed by dissolving a fusible core enclosed in the crown. The core is dissolved by flowing a dissolving liquid through an inlet or an outlet passage connecting the fusible core with the cavity.

According to a further feature of the invention, the piston is cast around the fusible core. In order to correctly position the fusible core during such casting, the fusible core is mounted to a strut which is itself supported by a plurality of cores which define the shape of the cavity.

The plurality of cores are comprised of first, second and third cores, in which the first cores comprise two mutually symmetrical cores, the second cores comprise two mutually symmetrical cores positioned between the first cores, and the third core separates the two second cores, and is enclosed by the first and second cores. The strut is supported by the cores via undercut portions formed on one of the first and second cores. The plurality of cores are shaped so that they may be removed from the cavity in the downward direction, i.e., in a direction opposite the fusible core.

BRIEF DESCRIPTION OF THE DRAWINGS

A more complete appreciation of the invention and many of the attendant advantages thereof will be readily obtained as the same becomes understood by reference to the following detailed description when considered in connection with the accompanying drawings, wherein.

DETAILED DESCRIPTION OF THE PREFERRED EMBODIMENTS

Figure 1:
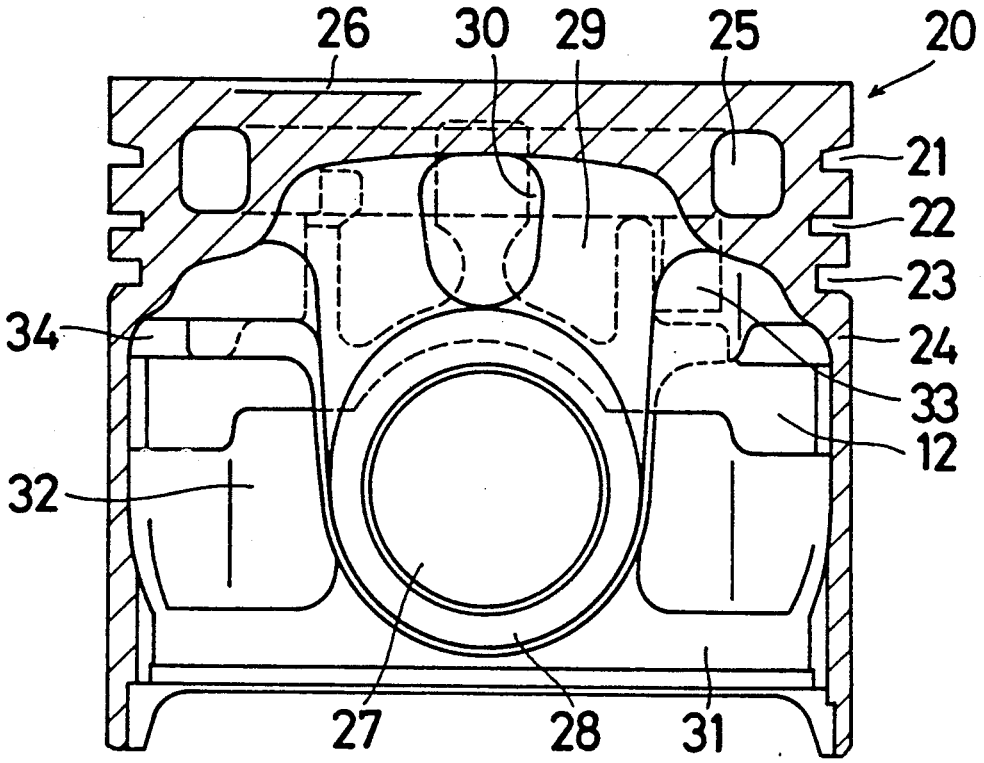
FIG. 1 is a partial sectional view of a piston which is manufactured by the invention.
Figure 2:
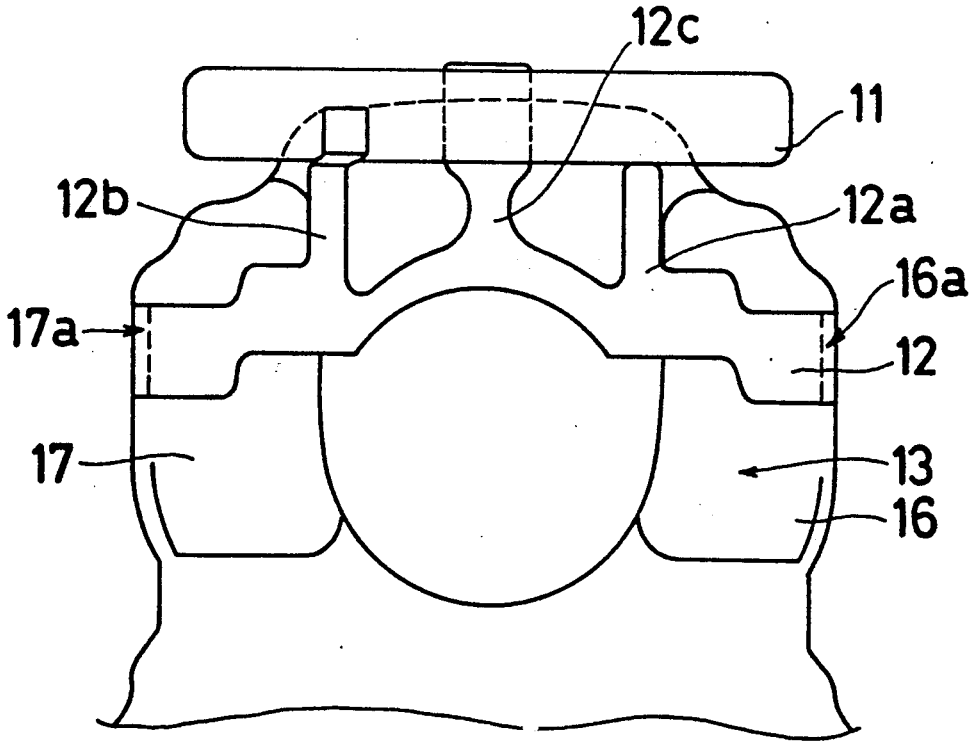
FIG. 2 is a front view of cores and a strut according to the invention.
Figure 3:
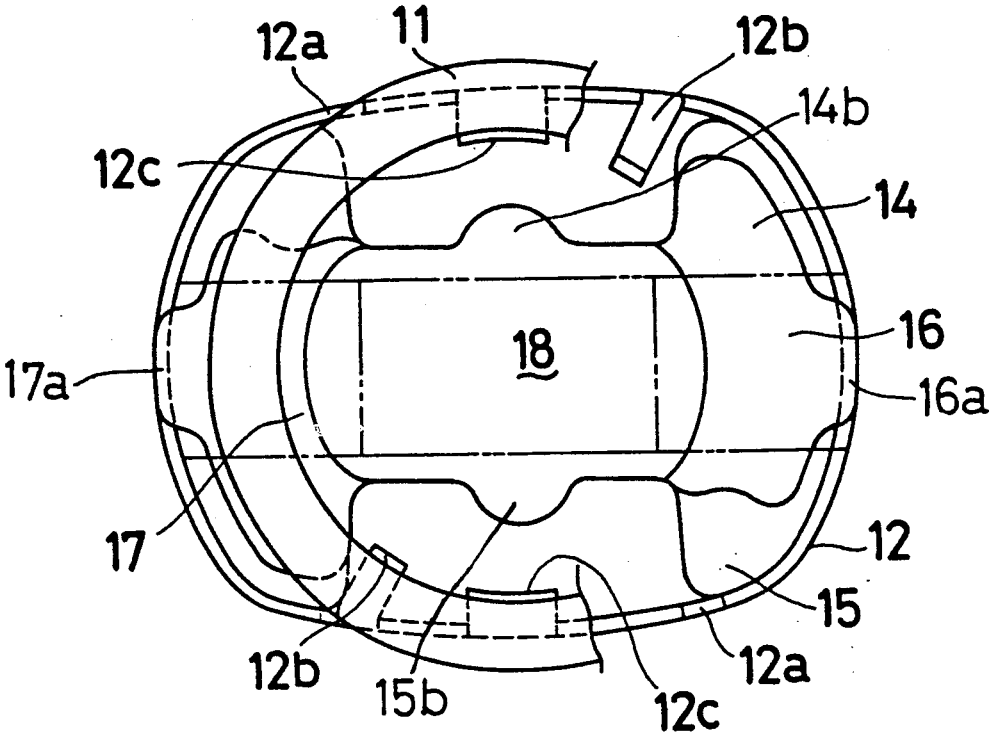
FIG. 3 is a top plan view of the assembly shown in FIG. 2.

Referring first to the embodiment of the present invention shown in FIGS. 1–3, there is shown a piston 20. A fusible core 11 is fixed to a strut 12 via keeping portions 12*a* 12*b*, 12*c*, 12*d* of the strut such that the fusible core 11 does not come off the strut 12, for example it may be elastically held by the keeping portions. The fusible core 11 is made of salt, for example.

Another core 13 is composed of a pair of first cores 14, 15, a pair of second cores 16, 17, and third core 18 (the chain lines in FIG. 3 indicate the edges of the first, second and third cores). The first cores 14, 15 are mutually symmetrical and have undercut portions 14*b*, 15*b* for accommodating bosses 30, 30 (only one is shown). The second cores 16, 17 are mutually symmetrical and have undercut portions 16*a*, 17*a* to receive the strut 12.

The method for manufacturing a piston according to the first embodiment is described hereinafter:

The first cores 14, 15 are set on a lower mold (not shown). The strut 12 with the fusible core 11 is set on the first cores 14, 15. The second cores 16, 17 are inserted between the core 14 and the core 15 from the bottom at FIG. 2. The undercut portions 16*a*, 17*a* are then engaged with the strut 12, so that the strut 12 does not come off the second cores 16, 17. The third core 18 is then inserted into the cores 14, 15, 16, 17 from the bottom at FIG. 2. The strut is thus supported by the cores 14–18, with the annular body of the strut holding the cores 14–18 together. Last, an upper mold (not shown) is set on the lower mold, and an amount of melted aluminum or aluminum in the form of liquid are poured into the molds. The core 13 defines a cavity 32 in the cast piston.

After pouring the aluminum, the third core 18 is first drawn out downwardly from the core 13. The second cores 16, 17 are slid towards center of the core 13, before the second cores 16, 17 are drawn out downwardly. Therefore, the undercut portions 16*a*, 17*a* do not disturb the strut when drawing out the second cores 16, 17. Next, the first cores 14, 15 are slid towards center of the core 13, before the first cores 14, 15 are drawn out downwardly. Therefore, the undercut portions 14*b*, 15*b* do not disturb the bosses when drawing out the first cores 14, 15.

An inlet 33 and the outlet (not shown) are dug or cut in the piston to communicate between the fusible core 11 and the cavity 32 left by the removed core 13. The fusible core 11 is fused (i.e., dissolved) by a dissolving liquid such as water that is poured into the inlet 33, so that a cooling channel 25 is formed.

Ring-shaped grooves 21, 22, 23 are cut in the peripheral surface of the piston 20 above a skirt 24, and a groove 26 is cut on the surface of the piston 20. A pair of holes 27 for a pin is cut in the skirt 24. A boss for a pin 28, ribs 29, 31, an undercut portion for boss 30 and an undercut portion 34 are formed during casting.

The above first embodiment has many advantages. For example, the strut 12 with the fusible core 11 is securely fixed to the core 13 so that when pouring aluminum, the strut 12 is prevented from rising. Thus, the cooling channel 25 is formed at the correct position.

Figure 4:
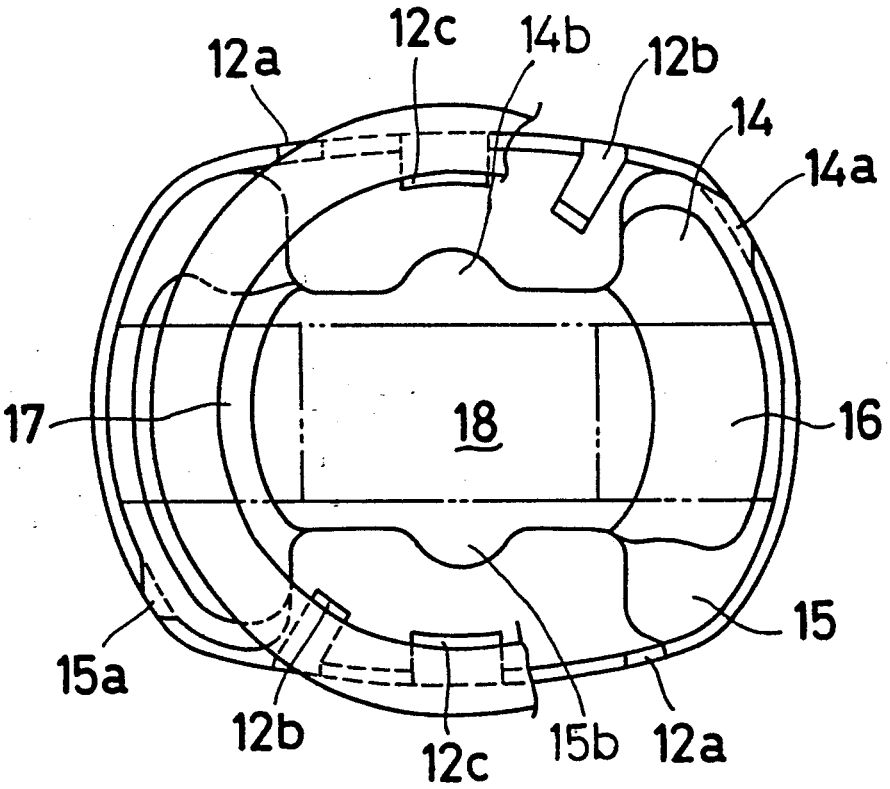
FIG. 4 is similar to FIG. 2, but showing another embodiment according to the invention.
Figure 5:
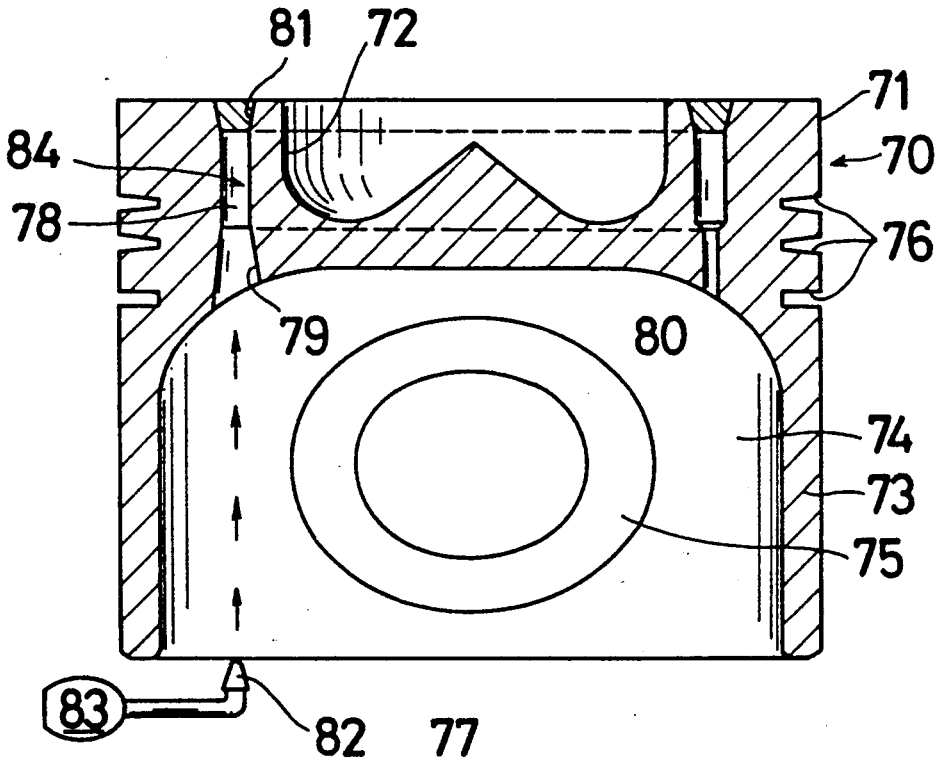
Fig. 5 PRIOR ART
FIG. 5 is similar to FIG. 1, but showing a piston cast by a known method.

Next, referring to FIG. 4 which shows a method for manufacturing a piston of a second embodiment according to the present invention, only the different construction from the first embodiment will be described hereinafter:

In the second embodiment, the second cores 16, 17 do not have the undercut portions 16*a*, 17*a*. But the first cores 14, 15 have undercut portions 14*a*, 15*a*.

The advantages according to the second embodiment are the same as in the first embodiment.

Obviously, numerous modifications and variations of the present invention are possible in light of the above teachings. It is therefore to be understood that within the scope of the appended claims, the invention may be practiced otherwise than as specifically

What is claimed as new and desired to be secured by Letters Patent of the United States is:

1. A piston assembly comprising:

a cast piston having a crown and a peripherally depending skirt, said crown and skirt defining a cavity on a lower side of said crown;

first, second and third cores removably positioned in the cavity, wherein said first and second cores are arranged to laterally enclose said third core, and wherein one of said first and second cores has undercut portions;

a strut having engaging portions engaged in said undercut portions such that said strut is supported by said first, second and third cores, said strut also having keeping portions;

a fusible core enclosed in said crown and fixed to said strut by said keeping portions; and inlet and outlet passages formed in said crown and extending between said fusible core and said cavity, whereby a cooling channel is left in said crown when said fusible core is dissolved by a dissolving liquid introduced through one of said inlet and outlet passages.

2. The piston assembly of claim 1 wherein said first cores comprise two mutually symmetrical cores, and wherein said second cores comprise two mutually symmetrical cores positioned between said first cores and being separated by said third core.

3. The piston assembly of claim 2 wherein said undercut portions are formed in said second cores.

4. The piston assembly of claim 2 wherein said undercut portions are formed in said first cores.

5. The piston assembly of claim 1 wherein at least one of said crown and said skirt defines bosses extending into the cavity, the bosses having holes for accommodating pins.

6. A method for making a piston having a cooling channel, comprising the steps of:

assembling an assembly comprising a strut supporting a fusible core and being supported by a plurality of cores configured to be separable from said strut in a direction opposite said fusible core;

positioning said assembly in a mold and casting a piston around said assembly such that said fusible core is enclosed in a crown of said piston and said plurality of cores are held in a cavity of said piston, the cavity being open in said direction opposite the fusible core;

removing said plurality of cores from said cavity by separating said plurality of cores from said strut in said direction opposite the fusible core;

forming inlet and outlet passages extending between said fusible core and the cavity; and dissolving said fusible core by introducing a dissolving liquid through one of said inlet and outlet passages, whereby a cooling channel remains in said piston.

7. The method of claim 6 wherein said strut is assembled to said plurality of cores by causing engaging portions of said strut to engage undercut portions of said plurality of cores.

* * * * *